United States Patent [19]

Araya

[11] Patent Number: 5,006,902

[45] Date of Patent: Apr. 9, 1991

[54] IMAGE FORMING APPARATUS HAVING A PREDETERMINED VOLTAGE APPLIED TO THE TRANSFER MEMBER

[75] Inventor: Junji Araya, Yokohama, Japan

[73] Assignee: Canon Kabushiki Kaisha, Tokyo, Japan

[21] Appl. No.: 213,121

[22] Filed: Jun. 29, 1988

[30] Foreign Application Priority Data

Jun. 30, 1987 [JP] Japan ..... 62-163562

[51] Int. Cl.[5] ..... G03G 15/14; G03G 15/02

[52] U.S. Cl. ..... 355/271; 355/219

[58] Field of Search ..... 355/271, 273, 274, 276, 355/219

[56] References Cited

U.S. PATENT DOCUMENTS

| | | | |
|---|---|---|---|
| 2,934,649 | 4/1960 | Walkup | 355/219 X |
| 3,697,171 | 10/1972 | Sullivan | 355/274 X |
| 3,832,055 | 8/1974 | Hamaker | 355/274 |
| 3,847,478 | 11/1974 | Young | 355/276 X |
| 3,984,182 | 10/1976 | Gundlach et al. | 355/273 |
| 4,077,709 | 3/1978 | Borostyan et al. | 355/276 X |
| 4,105,320 | 8/1978 | Bean | 355/276 X |
| 4,268,157 | 5/1981 | Ebi et al. | 355/274 X |
| 4,338,017 | 7/1982 | Nishikawa | 355/274 X |
| 4,355,884 | 10/1982 | Honda et al. | 355/276 X |
| 4,415,254 | 11/1983 | Nishikawa | 355/274 |
| 4,468,110 | 8/1984 | Tanigawa et al. | 355/273 X |
| 4,547,060 | 10/1985 | Lindblad | 355/219 |

FOREIGN PATENT DOCUMENTS

| | | | |
|---|---|---|---|
| 0272072A2 | 6/1988 | European Pat. Off. . | |
| 0280542A2 | 8/1988 | European Pat. Off. . | |
| 3104212A1 | 12/1987 | Fed. Rep. of Germany . | |
| 56-147152 | 11/1981 | Japan | 355/276 |
| 59-206853 | 11/1984 | Japan | 355/273 |

*Primary Examiner*—Fred L. Braun

*Attorney, Agent, or Firm*—Fitzpatrick, Cella, Harper & Scinto

[57] ABSTRACT

An image forming apparatus includes an image bearing member, image forming device for forming an image on the image bearing member, a transfer charger for transferring the image formed on the image bearing member by the image forming device onto an image receiving member, the transfer charger including a transfer member contacted to the image bearing member and voltage application source for applying a voltage to the transfer member to transfer the image from the image bearing member to the image receiving material, wherein the voltage which is applied to the transfer member from the voltage application source at least during image transfer action by the image transfer charger, is lower than a charge starting voltage of the transfer member between itself and the surface of the image bearing member.

28 Claims, 3 Drawing Sheets

IMAGE FORMING APPARATUS HAVING A PREDETERMINED VOLTAGE APPLIED TO THE TRANSFER MEMBER

FIELD OF THE INVENTION AND RELATED ART

The present invention relates to an image forming apparatus such as an image transfer type electrophotographic copying apparatus, a laser beam printer or the like, wherein a surface of an image bearing member such as a photosensitive member in the form of a drum, an endless belt or the like which is rotated or revolved, is uniformly charged and is subjected to an image exposure by which an electrostatic latent image is formed; the latent image is developed into a toner image, which is then transferred onto an image receiving material such as paper, so that an image is formed on the image receiving member, while the image bearing member is repeatedly used.

Referring first to FIG. 8, there is shown a structure of one of generally used image transfer type electrophotographic copying machines using a photosensitive member in the form of a drum.

The copying machine shown in this Figure comprises a photosensitive drum 1 functioning as the image bearing member, which is rotatable about a shaft 1*a* in the direction indicated by an arrow at a predetermined peripheral speed. While the photosensitive drum 1 is being rotated, it is subjected to an operation of a charging device 2, by which the peripheral surface thereof is electrically charged to a predetermined potential in a negative or positive polarity. After the uniform charging, the photosensitive drum is exposed to image light L at an exposure station 3 by an unshown exposing device through a slit or by a laser beam scanning action. By this, an electrostatic latent image is sequentially formed in accordance with the light image on the peripheral surface of the photosensitive member. The electrostatic latent image is developed by a developing device 4 with toner into a toner image, which is then transferred by a transfer device 5 onto an image receiving material P which is supplied into a space between the photosensitive member 1 and the image transfer device 5 in timed relation with the rotation of the photosensitive member 1.

The image receiving material P having received the image is separated from the surface of the photosensitive drum 1, and is conveyed into an image fixing device 8, where the toner image is fixed, and thereafter, the image receiving material P is discharged out of the copying machine as a copy.

On the other hand, the surface of the photosensitive drum 1, after the image is transferred from the image receiving material P, is cleaned by a cleaning device 6 on its outer periphery, so that the residual toner remaining thereon is removed, thus being prepared for the repeated image forming operation.

As for the charging device 2 for uniformly charging the photosensitive member 1, a corona charging device with a wire electrode, which is known, is widely used. Also, as for the transfer device 5, a corona transfer device is widely used.

When a corona charging device is used as the charging device, it has been considered that a preexposure step is required which electrically discharges the photosensitive member 1 which is repetitively used, by exposing the photosensitive member 1 to uniform light prior to the uniform charging step, and that a post-exposure step is required which discharges the photosensitive member after completion of the image information to remove the potential remaining thereon.

In other words, in order to allow the photosensitive member 1 to be repetitively used, the electric potential contrast of the electrostatic latent image remaining on the surface of the photosensitive member 1 by the previous image formation, must be dissipated prior to the uniform charging step for the next image forming operation. This is because, if the surface of the photosensitive member is subjected to a uniform charging operation for the next image formation without removing the electrostatic contrast of the previous electrostatic latent image when a conventional corona charging device 2 is used, the whole surface of the photosensitive member is not uniformly charged, and therefore, electrostatic contrast by the previous electrostatic latent image remains, by which the remaining image appears as a ghost image in the next image formed.

Also, after the completion of the image forming operation, the image forming machine is required to be stopped after the potential on the photosensitive member 1 is dissipated. This is because if the photosensitive member 1 is left with the electric charge remaining thereon, the characteristics of the photosensitivity of the photosensitive member or the like is liable to be changed.

To obviate this problem, a whole surface exposure device 7 (eraser) for exposing the photosensitive member 1 to uniform light is disposed between the corona charging device 2 and a cleaning device 6 to electrically discharge the photosensitive member 1. By this, in each of the image forming cycles using the photosensitive member 1 repetitively, the photosensitive member 1 is exposed to uniform light by the whole exposure device 7 to be electrically discharged before the charging by the charging device 2, and therefore, the photosensitive member can be uniformly charged by the corona charging device 2 for the next image forming operation. The photosensitive member 1 is rotated through at least one full turn (post-rotation or post-revolution) after the corona charging device 2 and the corona transfer device 5 are deactivated. During the post rotation or post-revolution, the entire surface of the photosensitive member is exposed to uniform light by the whole surface exposure device 7 so that the whole surface thereof is electrically discharged, and thereafter, the rotation of the photosensitive member is stopped and is prepared for the next image forming operation.

When the conventional corona transfer device 5 is used, the photosensitive member 1 is directly charged by the corona charging device 5 except when the toner image on the photosensitive member 1 is transferred onto the image receiving material, that is, when the image receiving material is not present in the space between the photosensitive member 1 and the corona transfer device 5. On the other hand, during the image transfer operation, the image receiving material is in the space between the photosensitive member 1 and the corona transfer device 5, that area on the photosensitive member 1 which correspond to the image receiving material, is not charged by the corona transfer device 5. This produces an electrical potential difference between the area charged by the corona transfer device 5 and the area not charged. This difference is not eliminated completely by the whole exposure device 7, and therefore, it can appear as a density difference in accordance with the potential difference.

In the electrophotographic apparatus such as a laser beam printer or the like wherein the reversal development is performed, the photosensitive drum 1 is uniformly charged to a positive polarity, when, for example, the photosensitive drum 1 has a photosensitive layer made of a negative property OPC (organic photoconductor). Then, a laser beam is projected onto the photosensitive member 1 in accordance with image information to be recorded to produce a high potential area not exposed to the laser beam and a low potential area exposed to the laser beam. Thereafter, the photosensitive member 1 is subjected to a reversal development with the toner particles electrically charged to a negative polarity which is the same as the polarity to which the photosensitive member is charged by the charging device 2, by which the toner particles are deposited onto the area of the photosensitive member 1 which has the low potential. Using the corona transfer device 5 supplied with a positive voltage, the developed image is transferred from the photosensitive member 1 to the image receiving material P. At this time, if the photosensitive member 1 is directly charged by the transfer device 5 without the image receiving material P therebetween, the positive charge provided by the corona transfer device 5 is not discharged by the whole surface exposure device 7, because the photosensitive member is of a negative property. Therefore, particularly when the reversal development is employed, the image density difference is remarkable in the next image.

FIG. 9 is a timing chart illustrating the timed relation between operations of each of the elements to avoid the above-described problems. As will be understood from this chart, the corona transfer device 5 is required to operate only during the period in which the image receiving material P is contacted to the photosensitive member 1 to transfer the image onto the image receiving material P. Therefore, the charging device 2, the corona transfer device 5 and the whole surface exposure device 7 have to be controlled in different sequential schedules, whereby the sequential operations are complicated.

When a corona discharging device having a wire electrode is used as the transfer device, it is required that the wire electrode is supplied with a high voltage such as several KV. In addition, in order to maintain a large distance between the wire electrode and the shield electrode (known) enclosing the wire electrode, the size of the discharging device is large. Also, the corona discharging device produces a relatively larger amount of ozone, the photosensitive member is deteriorated thereby, which leads to blurred images. Furthermore, when the corona transfer device 5 is employed, there are such problems that an additional means for conveying the image receiving material P is required and that the image is deviated due to transfer deviation when the image receiving material P is not correctly contacted to the photosensitive member 1, because of the existence of the space between the photosensitive member 1 and the corona charging device 5.

U.S. Pat. Nos. 3,697,171 and 3,832,055 propose that a transfer roller is used in place of the corona transfer device in order to prevent the transfer deviation and to improve the conveyance of the image receiving material P. However, this does not solve the problem of the image density difference in the next image due to the presence and the absence of the image receiving material P on the photosensitive member 1 at the transfer station.

SUMMARY OF THE INVENTION

Accordingly, it is a principal object of the present invention to provide an image forming apparatus which is made small and simple with low cost, by simplifying the sequential outputs of the charger, the image transfer device and the charging device or the like, which is accomplished by increasing the latitude of the sequential operation of the image transfer device.

It is another object of the present invention to provide an image forming apparatus provided with an image transfer device which does not require as high a voltage as the conventional corona transfer device having a wire electrode necessiates, and in which the efficiency is good with a relatively low voltage and with a relatively small amount of ozone produced.

It is a further object of the present invention to provide an image forming apparatus wherein the conveyance of the image receiving material is assured during the image transfer operation so that the transfer deviation does not occur.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
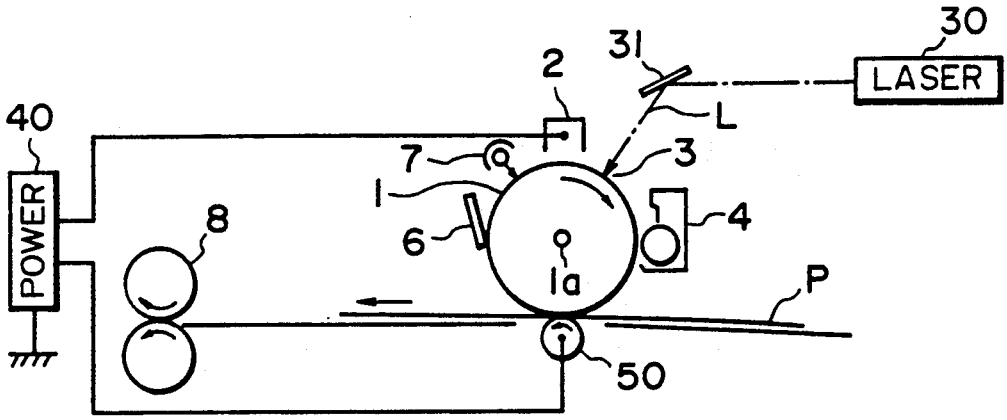
FIG. 1 is a schematic sectional view of an example of a laser beam printer according to an embodiment of the present invention.

Referring to FIG. 1, there is shown a laser beam printer according to an embodiment of the present invention which employs a reversal development. In FIG. 1, the same reference numerals are assigned as with FIG. 8 to the elements performing the corresponding functions to avoid repeated description.

The photosensitive member 1 is made of an organic photoconductor (OPC) and is uniformly charged to −700 V by a conventional corona charging device.

Figure 8:
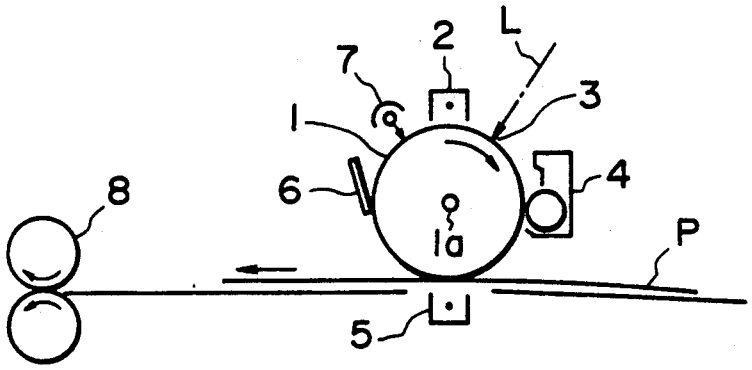
FIG. 8 PRIOR ART
FIG. 8 is a schematic conventional image forming apparatus which employs a uniform charging means in the form of a corona charging device and a corona transfer device in the form of a corona charging device.
Figure 9:
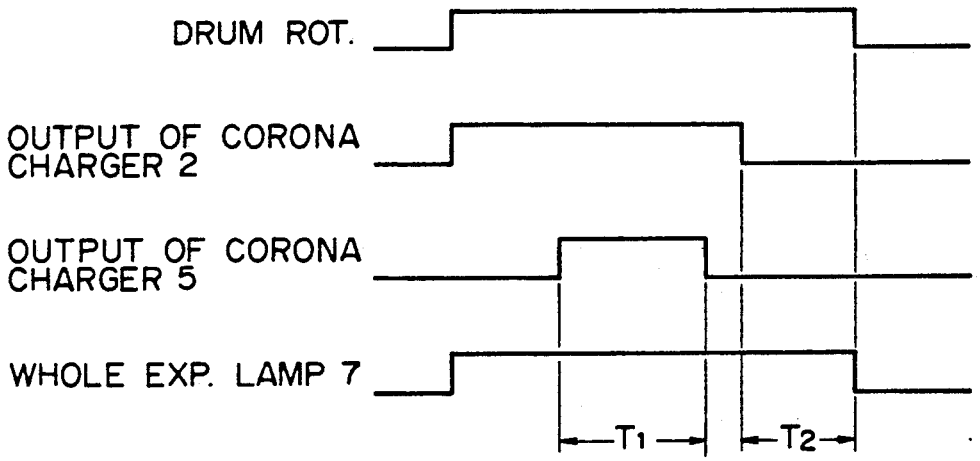
FIG. 9 PRIOR ART
FIG. 9 is a timing chart (sequence) of the apparatus shown in FIG. 8.

The toner image formed on the photosensitive member 1 is transferred onto the image receiving material P not by a corona transfer device 5 as shown in FIG. 8 but by a roller transfer device. The roller transfer device includes a conductive transfer roller 50 which is contacted to the photosensitive member 1. The transfer roller 50 comprises a core metal and a conductive layer having a resistance of $10^2 - 10^8$ ohm and having a conductivity at its surface (made of conductive urethane rubber having the resistivity of $10^5$ ohm.). Here, the resistance is the one from the core metal to the roller surface per 1 $cm^2$ at the roller surface. Other usable rubber materials are EPDM, NBP, CR or the like. The transfer roller 50 is maintained normally in press-contact with the surface of the photosensitive member 1 under a predetermined pressure, for example, 10–100 g/cm (line pressure). By employing the urethane rubber having continuous pores, the pressure between the transfer roller 50 and the photosensitive member 1 can be reduced, and simultaneously, the nip between the transfer roller 50 and the photosensitive member 1 can be made sufficient, and it is preferable. In this embodiment, the transfer roller 50 is driven from an unshown photosensitive drum driving gear, and the peripheral speeds of the photosensitive member 1 and the transfer roller 50 are the same so that the transfer deviation is avoided. However, it is possible to allow the transfer roller 50 to rotate following the photosensitive member 1 by the contact therebetween.

The transfer roller 50 and the corona charger 2 are supplied with electric power by a voltage source 40.

The apparatus comprises a known laser scanner unit 30, by which a laser beam is modulated in accordance with an image signal and is scanningly deflected. The laser beam is projected by way of a mirror 31 onto the surface of the photosensitive member 1, so that an electrostatic latent image is formed by lowering to −150 V the electric potential at the portions where the laser beam is projected. A developing device 4 performs a reversal development with one component insulative magnetic toner which has been charged to a negative polarity, by which a toner image is formed on the photosensitive drum surface.

This toner image is transferred at the transfer station from the photosensitive member 1 to the image receiving material P by the transfer roller 50. It has been confirmed that good image transfer can be performed without the transfer deviation when a DC voltage of +500 V is applied thereto from the power source 40.

Figure 2:
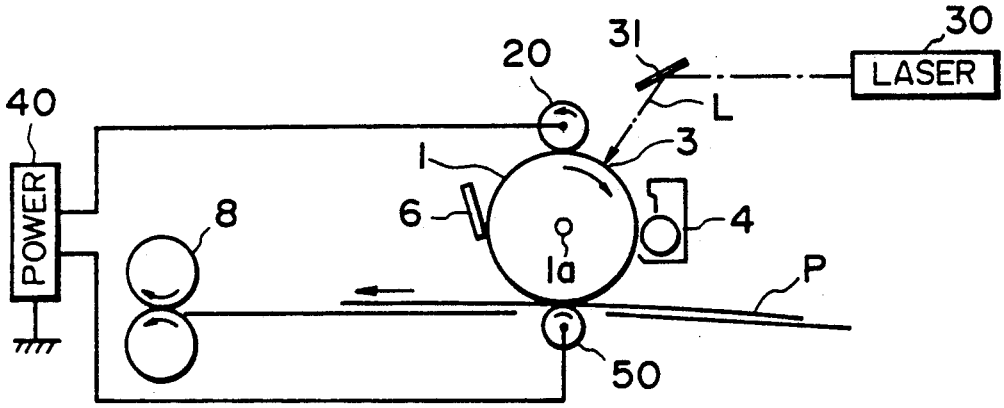
FIG. 2 is a sectional view of a laser beam printer according to another embodiment of the present invention.

Referring to FIG. 2, there is shown an influence of the transfer roller 50 to the charging of the photosensitive member 1 in the absence of the image receiving material P. When a DC voltage is applied to the transfer roller 50, the surface of the photosensitive member 1 starts to be electrically charged when the voltage becomes approximately 560 V.

Figure 3:
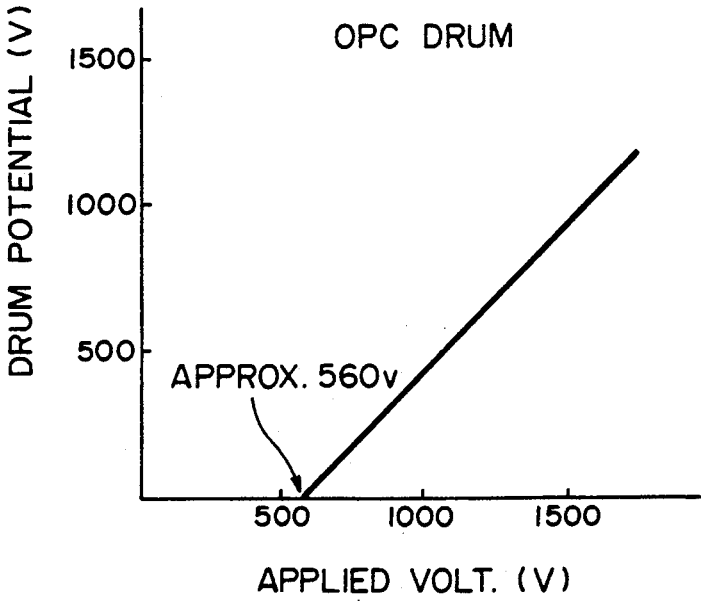
FIG. 3 is a graph of a surface potential of the charged photosensitive member and a DC voltage applied to the transfer roller when an OPC photosensitive drum is used.

FIG. 3 is a graph of the relationship between the voltage and the surface potential when the voltage is over the charge starting voltage (approximately 560 V), which was experimentally obtained. As will be understood, the relationship is linear with inclination of 1:1. Since the DC voltage applied to the transfer roller 50 is +500 V which is lower than the charge starting voltage, and therefore, the photosensitive member 1 is not charged by the transfer roller. Since however, the transfer roller 50 has to be effective to transfer the toner image from the photosensitive member 1 to the image receiving material P under good conditions, it is preferably not less than 250 V.

Here, the charge starting voltage is defined in the following manner. The DC voltage is applied to the transfer roller 50 functioning as a charging member contacted to the image bearing member functioning as a member to be charged and having an initial voltage of 0 V, and the voltage is gradually increased. Then, the surface potential of the photosensitive member charged by the transfer roller 50 is plotted against the applied DC voltage. The DC voltages are increased at intervals of 100 V from the voltage at which any surface potential other than 0 V appears first on the photosensitive drum, and ten plots are obtained. On the basis of those ten points, a rectilinear line is drawn using the least square approximation method. The rectilinear line is extended to cross with the line indicative of the surface potential of 0 V, and the applied voltage corresponding to the crossing point is defined as the charge starting (on-set) voltage. The line shown in FIG. 3 was provided by the least square approximation method.

The charge starting voltage varies depending on the materials and thicknesses or the like of the photosensitive member to be charged and the transfer roller as the charging member. In this example, the photosensitive layer of the photosensitive drum 1 is of azo pigment for CGL (carrier generating layer) and a mixture of hydrazone and resin thereon as CRL (carrier transportation layer) having a thickness of 19 microns, to constitute a negative polarity organic photoconductor layer (OPC layer). The transfer roller 50 comprises a core metal (steel) having a diameter of 6 mm and a conductive urethane rubber layer. The transfer roller 50 has a diameter of 16 mm and a volume resistivity of $10^5$ ohm.cm.

As described in the foregoing, the transfer roller 50 is supplied with a DC voltage of +500V irrespective of the presence and absence of the image receiving material P. However, it does not charge the surface of the photosensitive member. Therefore, there is no problem that the negative polarity OPC photosensitive member is positively charged and is unable to be discharged electrically. The voltage applied to the transfer roller 50 is not limited to a DC voltage, but a triangular, rectangular, pulsewise and sine pulse having a component of a polarity opposite to the electric charge of the toner, provided that it does not charge the photosensitive member.

In this manner, the photosensitive member 1 is repeatedly used to form images. After completion of the image formation, the surface of the photosensitive member 1 is subjected to a whole surface exposure by the whole surface exposure device 7 so as to stop the image forming apparatus after being electrically discharged.

Figure 4:
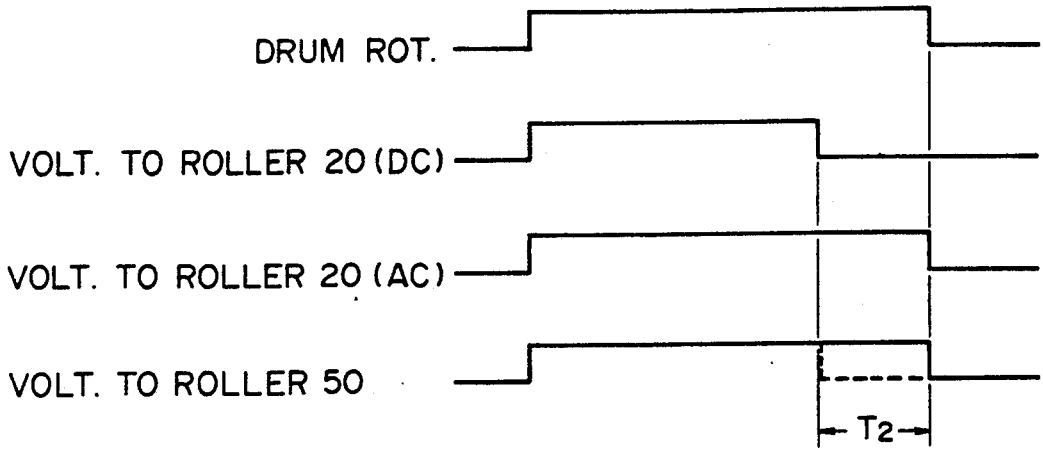
FIG. 4 is a timing chart (sequence) of the laser beam printer.

Referring to FIG. 4, there is shown a timing chart illustrating operational relations among the rotation of the photosensitive drum 1, an applied voltage to the corona charging device 2, a voltage applied to the transfer roller 50 and the whole surface exposure device 7.

According to this embodiment, the toner image transfer from the photosensitive member 1 to the transfer material P is effected not by a corona transfer device but by a transfer roller 50 supplied with a DC voltage which is lower than the charge starting voltage at which the photosensitive member starts to be charged. Therefore, even in the absence of the image receiving material P at the transfer station, as when the pre-rotation or the post rotation of the photosensitive drum 1 is performed, the DC voltage supply to the transfer roller 50 may be maintained to be supplied, without production of the potential difference on the surface of the photosensitive member 1 depending on the presence or absence of the image receiving material P at the transfer station.

This provides a larger latitude of the ssequential control of the transfer device. For example, the timing at which the charging devices 2 is actuated or deactuated may be made the same as the timing at which the voltage supply to the transfer roller 50 is started or stopped. This makes the sequential control simpler. Since the power supply to the charging device 2 and the power supply to the transfer roller 50 may be performed at the same time, the same transformer can be used as the power source for supplying voltage to the charging device 2 and the transfer device 50. Therefore, the apparatus may be made smaller, simpler and lower in cost.

Since the corona discharger 5 is not used as the transfer device, but a transfer roller 50 is used in place thereof, the production of ozone is reduced; the transfer material can be conveyed with certainty at the transfer operation; and a good image can be provided without transfer deviation. Referring to FIG. 2, another embodiment of the present invention will be described. The same reference numerals as with the foregoing embodiment are assigned to the elements having the corresponding functions, and the description thereof is omitted for the sake of simplicity.

In this embodiment, the photosensitive member 1 is charged not by the corona charging device 2 as shown in FIG. 1, but by a contact type charging device 20. The details of the contact type charging device 20 are the same as described in U.S. application Ser. No. 159,917 filed on Feb. 24, 1988 and having been assigned to the assignee of this application, and, the detailed explanation is omitted. In this embodiment, the charging device 20 is a roller made of a conductive rubber contacted to the photosensitive member 1. The charging device or the charging roller 20 may be the same as the transfer roller 50 in the foregoing embodiment, and is press-contacted to the surface of the photosensitive member 1 under predetermined pressure, for example, 10-100 g/cm (line pressure). In this embodiment, the charging roller 20 rotates following the rotation of the photosensitive member 1. The charging roller 20 may be rotated in the same direction as or the opposite direction to the photosensitive member 1 at the position where they are contacted, or it may not be rotated. However, what is preferable is that the charging roller 20 is rotated at the same speed and in the same peripheral direction at the photosensitive member 1 at the position where they are contacted, or that the charging roller 20 is driven by the contact with the photosensitive member. This is because, the friction between the charging roller 20 and the photosensitive member 1 is smaller than when there exist a speed difference between the charging roller 20 and the photosensitive member 1, and therefore, the problem of wearing of those elements is not significant.

The charging roller 20 and the transfer roller 50 are supplied with voltages from the voltage source 40.

To the charging roller 20, a superimposed voltage $V_{DC} + V_{AC}$ of a DC voltage $V_{DC}$ and an AC voltage $V_{AC}$ is applied from the voltage source 40 during the pre-rotation period of the photosensitive member 1 and during each of the image forming cycles repeated. In this embodiment, the DC component $V_{DC}$ was $-700$ V, and the AC component $V_{AC}$ had a peak-to-peak voltage Vpp of 1500 V and a frequency of 1000 Hz in the form of a sine wave. By this, the surface of the photosensitive member 1 was uniformly charged to $-700$ V. The laser beam produced and modulated in accordance with an image signal by the laser scanning unit 30 is applied by way of the mirror 31 onto the surface of the photosensitive member 1, so that the surface potential of the photosensitive member at the image portion (exposed portion) becomes $-150$ V. In this manner, an electrostatic latent image is formed, and the developing device 4 performs a reversal development with the toner negatively charged to form a toner image on the surface of the photosensitive drum 1.

The toner image is transferred onto the image receiving material P by the transfer roller 50 supplied with a DC voltage of $+500$ V from the power source 40. It has been confirmed that good image transfer is obtained with those conditions. In this embodiment, too, the DC voltage of $+500$ V applied to the transfer roller 50 is not more than the charge starting voltage, and therefore, the photosensitive member 1 is not charged by the transfer roller 50. For this reason, no potential difference is produced on the photosensitive member 1 irrespective of the presence or absence of the image receiving material P in the transfer station, and therefore, no image density difference is produced in the next image formation resulting from the presence and absence of the image receiving material P.

Since this structure does not include the preexposure means which has been necessiated in the conventional art for the surface of the photosensitive member immediately before the charging roller 20, the potential contrast of the electrostatic latent image due to the previous image formation remains when the photosensitive member 1 is repeatedly used for the image formation. However, the photosensitive member 1 is uniformly charged to $-700$ V in this embodiment, after it has passed by the charging roller 20. Therefore, even without the preexposure the image is substantially free from the ghost resulting from the previous electrostatic latent image. The uniformity of the charging by the charging roller 20 derives from the fact that the superimposed DC and AC voltages are applied thereto. When a DC voltage only wa applied to the charging roller 20 to charge the photosensitive member with the DC voltage of $-1200$ V - $-1300$ V, the surface of the photosensitive member 1 was charged to approximately $-700$ V, but the uniformity of the charging was not good so that when the photosensitive member 1 was used repeatedly, the potential contrast of the previous electrostatic latent image appeared as a ghost in the next image. The reason why the uniformity is provided by superimposing the AC voltage is considered as follows. The charging mechanism is considered as being dependent on the electric discharge occurring at or adjacent the position where the charging roller 20 and the photosensitive member 1 are contacted, and it is considered that due to the AC voltage component reversal discharge from the photosensitive member 1 to the charging roller 20 takes place, and this improves the uniformity of the charging.

The photosensitive member 1 is repeatedly used to form images. After completion of the image formations, the DC voltage component is removed, and only the AC voltage is supplied to the charging roller 20 so as to electrically discharge the surface of the photosensitive member 1 to be prepared for stopping and waiting for the next image forming operation. More particularly, during at least one full turn of the photosensitive member 1 for the post-rotation after the completion of the image forming operation, the voltage source 40 applies only the AC voltage $V_{AC}$ to the charging roller 20.

By applying the AC voltage only, the surface potential of the photosensitive member 1 is uniformly discharged to 0 V. This operation is effected more than one rotation of the photosensitive member 1, so that the entire surface of the photosensitive member 1 is electrically discharged. In this embodiment, the DC component is made zero, but this is not limiting, and a voltage of the DC component may be determined if it is a level at which the photosensitive member 1 is not influenced even if the photosensitive member is left as it is after the post rotation. As for usual photosensitive members, there will be no problem if the DC component is not more than 100 V. The AC voltage may be in a usual form, or may be in another form, if it is a vibratory voltage which periodically vibrates, and the waveform may be a sine wave, a triangular wave, a rectangular wave, a pulse wave or the like.

Similarly to the foregoing embodiment, the voltage to the transfer roller 50 is maintained +500 V, but it does not charge the photosensitive member surface.

After the post-rotation, the AC voltage applied to the charging roller 20 and the DC voltage (+500 V) applied to the transfer roller 50 are stopped, and the rotation of the photosensitive member 1 is stopped, then the apparatus is waiting for the next image forming operation.

Referring to FIG. 4, there is shown a timing chart showing the timing of the rotation of the photosensitive drum 1, the application of the voltage to the charging roller 20 and the voltage application to the transfer roller 50. Since, as will be understood from this figure, the time of the voltage application to the transfer roller 50 is the same as the AC component application to the charging roller 20, the AC component of the voltage applied to the charging roller 20 may be rectified and used as a voltage to be applied to the transfer roller 50. In this embodiment, the voltage applied to the transfer roller 50 is stopped simultaneously with the AC component of the voltage applied to the charging roller 20, but this is not limiting, and as shown by the broken lines, the voltage application to the transfer roller 50 is stopped earlier than shown in FIG. 4 by the time period T2 (more than one full turn of the photosensitive member 1), and then, the voltage application to the transfer roller 50 may be stopped simultaneously with the DC component of the voltage applied to the transfer roller 20.

In FIG. 4, the voltage applications to the charging roller and the transfer roller are started simultaneously with the start of the photosensitive drum 1 rotation, but this is not limiting, and the voltage applications to the charging roller and the transfer roller may be started after the start of the photosensitive drum 1 rotation.

According to this embodiment, the high voltage such as 5-6 KV as in conventional corona discharging device is not necessiated, and the sequential control for the voltage output is simple, and therefore, the cost and the size of the voltage source can be reduced. Additionally, there is almost no production of ozone as compared with the case of corona discharging, and therefore, the necessity for the means for disposing of the ozone or the means for preventing deterioration of the photosensitive member by ozone, is eliminated. Also, the necessities for the exposure device for the pre-exposure prior to the charging step for the photosensitive member and the exposure device for the post-exposure after the completion of the image formation, are eliminated, and the apparatus may be made smaller in size, simpler in structure and lower in cost.

Figure 10:
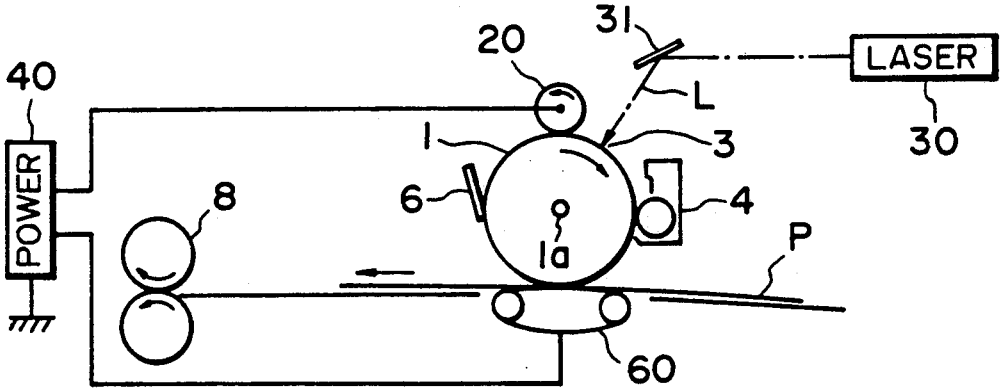
FIG. 10 is a schematic sectional view of a laser beam printer according to a further embodiment of the present invention employing a conductive belt as a transfer device.

Referring to FIG. 10, it is possible to use in place of the roller for the transfer device, a conductive belt 60 rotated by a roller or the like. When a transfer belt 60 is used, the image receiving material P is discharged out of the transfer station in close contact with the belt, and therefore, the image receiving material is slowly separated from the image bearing member, and therefore, the change in the electric field between the charge on the image bearing member and the toner on the image receiving material becomes slow, so that the transferred image is not disturbed.

Figure 5:
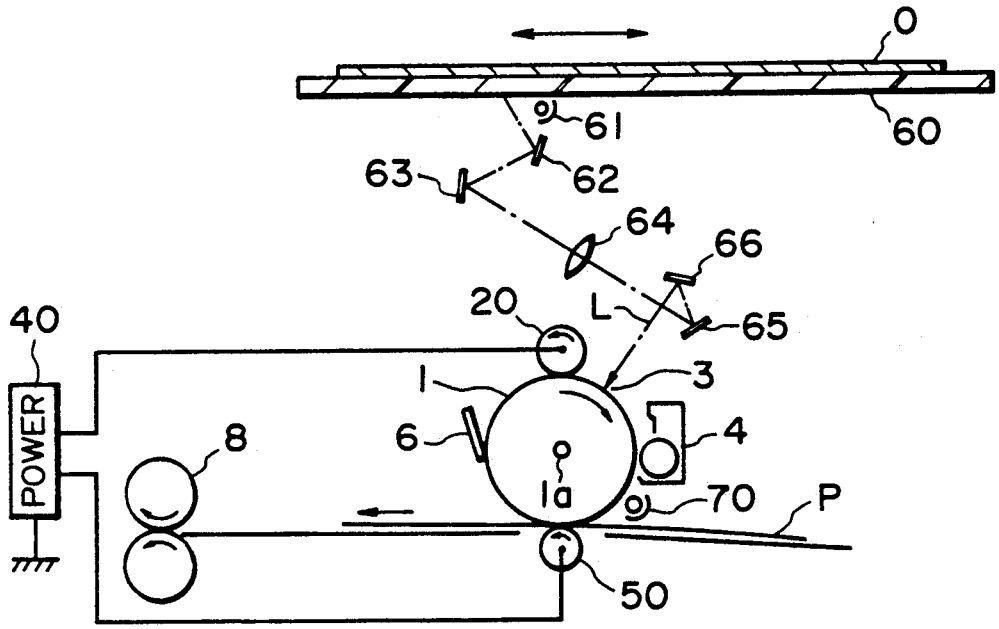
FIG. 5 is a sectional view of a copying apparatus according to an embodiment of the present invention.

FIG. 5 illustrates a copying machine according to a further embodiment of the present invention, wherein the same reference numerals are assigned as with FIGS. 1, 2 and 8 embodiments to the elements having the corresponding functions, and the detailed description thereof is omitted for the sake of simplicity.

The copying machine of this embodiment comprises an original supporting glass 60, on which an original 0 to be copied is placed thereon face down. The bottom side of the original 0 is illuminated and scanned by the exposure lamp 61 during a forward or backward stroke of the original supporting glass movement. The light reflected by the original is directed to the exposure station 3 by way of mirrors 62 and 63, an imaging lens 64 and mirrors 65 and 66, by which the surface of the photosensitive member 1 is exposed to the light image of the original through a slit, as indicated by a reference L.

The photosensitive drum 1 is charged to −700 V by the charging roller 20 and is exposed to the light image of the original by the exposure means, so that an electrostatic latent image is formed on the surface thereof. The electrostatic latent image is developed by the developing device 4 into a toner image (regular development). The photosensitive drum surface having the toner image is subjected to a whole surface exposure by a pre-transfer exposure device 70 for charge removal from the photosensitive member 1, prior to reaching the transfer roller 50. By this, the electric charge on the photosensitive drum is removed. The toner image is transferred onto the image receiving material P by the transfer roller 50 to which a DC voltage of −500 V is applied. It has been confirmed that a good image transfer operation can be performed with those conditions. Also, it has been found that without the pre-transfer exposure 70, a good image transfer action does not occur unless the transfer roller 50 is supplied with a DC voltage of not less than −1000 V. In the case of the reversal development, as in the foregoing embodiments, the good image transfer action can be obtained with +500 V although the pre-transfer exposure is not used, either. This difference can be explained as follows. In the case of the reversal development, the toner image present at a portion where the potential has been attenuated from the surface of the photosensitive drum, is transferred. By the provision of the pre-transfer exposure 70, the good image transfer action can be accomplished with the voltage of not more than 560 V (charge starting voltage) to the transfer roller 50. With this voltage, the photosensitive drum 1 is not electrically charged even if the voltage is applied to the transfer roller 50 when there is no image receiving material P in the transfer station. Therefore, the sequential control similar to that shown in FIG. 4 can be employed. The pre-transfer exposure 70 is effected through the toner image, so that it is not possible to completely dissipate the surface potential of the photosensitive drum 1, but it is effective to make the image transfer easier.

Figure 6:
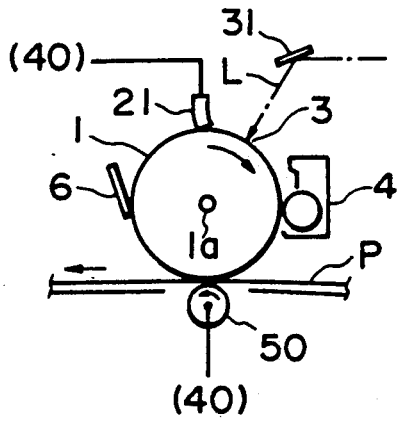
FIG. 6 and 7 are sectional views of image forming machines wherein contact type charging devices in the forms of a conductive rubber blade and a conductive brush are employed.
Figure 7:
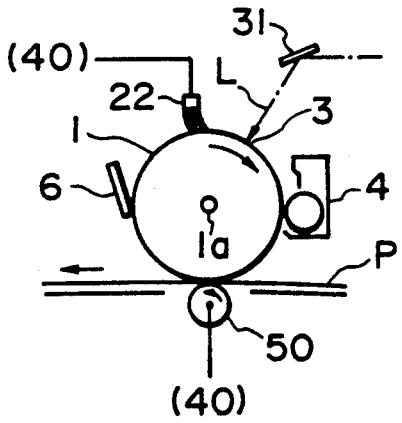

In the foregoing embodiments, the contact charging device 20 is in the form of a conductive roller, but a conductive rubber blade 21 may be conducted to the photosensitive drum 1, as shown in FIG. 6; and it may be in the form of a conductive brush 22 contacted to the photosensitive drum 1, as shown in FIG. 7.

As for another means for the pre-transfer processing to lower the voltage applied to the transfer roller 50 or the transfer belt 60 down to not more than the charge starting voltage, may be another means such as pre-transfer charging means or the like.

The material of the photosensitive member (image bearing member) is not limited to the OPC, but may be amorphous silicon, selenium, ZnO or the like. In addition, the image bearing member is not limited to the photosensitive ones, but may be a dielectric material drum. The image forming process is not limited to the Carlson process, but it may be a process including a step for uniformly charging the photosensitive member and a step for transferring the toner image onto the image receiving material. The image exposure means may be of a type wherein the original is stationary, while an optical system is moved, or in the form of a laser beam scanning exposure system, LED array control system, a liquid crystal shutter array control system or the like. Further, various process means disposed around the photosensitive drum for the image formation may be contained in a process cartridge as a unit.

As described in the foregoing, according to the present invention, when the image is transferred from the image bearing member to the image receiving member, a transfer member contacted to the image bearing member is supplied with a voltage less than the charge starting voltage with respect to the image bearing member, so that the sequential control for the voltage supply to the transfer member can have a larger latitude, whereby the sequential control for the charging, transferring, discharging operations or the like including the drive of the image bearing member, can be made simpler. The power source for the image transfer can have a lower voltage output, and, a good image without the transfer deviation can be obtained with lower production of ozone. Therefore, the size and the cost of the image forming apparatus of this kind can be minimized. Also, the structure of the image forming apparatus can be simple.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

image forming means for forming an image on a surface of said image bearing member; and transfer means for transferring the image formed on said image bearing member by said image forming means onto an image receiving member, said transfer means including a transfer member contacted to said image bearing member and voltage application means for applying a voltage between the transfer member and the image bearing member to transfer the image from said image bearing member to the image receiving material, wherein the voltage which is applied between the transfer member and the image bearing member from said voltage application means at least during image transfer action by said image transfer means, is lower than a charge starting voltage of the transfer member between itself and the surface of the image bearing member.

2. An apparatus according to claim 1, wherein the transfer member includes a rotatable roller.

3. An apparatus according to claim 1, wherein said transfer member includes a rotatable belt.

4. An apparatus according to claim 1, 2 or 3, wherein said image forming means includes charging means for charging said image bearing member, said charging means including a charging member and voltage application means for applying a voltage between the charging member and the image bearing member, said image forming means further including means for forming a latent image in accordance with image formation on the surface of said image bearing member which has been electrically charged by said charging means and developing means for developing the latent image.

5. An apparatus according to claim 4, wherein said developing means effects a regular development to develop the latent image, wherein said charging means has a charging polarity which is the same as that of the transfer means, said apparatus further comprising discharging means, disposed between said developing means and said transfer means with respect to movement direction of said image bearing member, for electrically discharging said image bearing member.

6. An apparatus according to claim 5, wherein actuation and deactuation of the voltage application means for said charging member and the voltage application means for the transfer member are synchronized.

7. An apparatus according to claim 4 wherein actuation and deactuation of the voltage application means for said charging member and the voltage application means for the transfer member are synchronized.

8. An apparatus according to claim 7, wherein the voltage application means for the charging member and the voltage application means for the transfer member are common.

9. An apparatus according to claim 4, wherein said charging member is in contact with said image bearing member to charge it.

10. An apparatus according to claim 9, wherein said voltage application means applies between the charging member and the image bearing member a superimposed voltage of a DC voltage and an AC voltage.

11. An apparatus according to claim 10, wherein said charging member functions also as a discharging member for electrically discharging said image bearing member.

12. An apparatus according to claim 11, further comprising a discharging member which effects its discharging operation for the surface of said image bearing member at least during one rotation of said image bearing member after completion of image formation, and during which an AC voltage is applied by the voltage application means for the charging member.

13. An apparatus according to claim 12, wherein actuation and deactuation of the voltage application means for applying an AC voltage component between the charging member and the image bearing member and the voltage application means for applying the voltage to the transfer member are synchronized, and wherein the voltage applied between the transfer member and the image bearing member is a rectified voltage from an AC voltage.

14. An apparatus according to claim 1, wherein actuation and deactuation of said transfer member are effected when the image receiving member is absent between said transfer member and the image bearing member.

15. An image forming apparatus, comprising:

an image bearing member;

charging means for charging a surface of said image bearing member;

latent image forming means for forming a latent image on the surface of said image bearing member having been charged by said charging means;

developing means for effecting a reversal development for the latent image on said image bearing member; and transfer means for transferring the developed image from said image bearing member to an image receiving material;

wherein said charging means includes a charging member and voltage application means for applying a voltage between the charging member and the image bearing member, wherein said transfer means includes a transfer member contacted to said image bearing member and voltage application means for applying between the transfer member and the image bearing member a voltage having a component of a polarity opposite to a polarity to which said image bearing member is charged by said charging means, wherein the voltage which is applied between said transfer member and the image bearing member by said voltage application means at least during the image transfer operation by said transfer means, is lower than a charge starting voltage of said transfer member between itself and said image bearing member.

16. An apparatus according to claim 15, wherein said transfer member includes a rotatable roller.

17. An apparatus according to claim 15, wherein said transfer member includes a rotatable belt.

18. An apparatus according to claim 15, wherein said voltage application means for said charging member and the voltage application means for said transfer member are simultaneously actuated and deactuated.

19. An apparatus according to claim 15, wherein said charging member is in contact with said image bearing member to charge the surface of said image bearing member.

20. An apparatus according to claim 19, wherein the voltage application means for the charging member applies a superimposed voltage of a DC voltage and an AC voltage.

21. An apparatus according to claim 19, wherein said charging member functions also as a discharging member for electrically discharging said image bearing member.

22. An apparatus according to claim 21, wherein said discharging member effects its discharging operation for the surface of said image bearing member at least during one rotation of said image bearing member after completion of image formation, and during which an AC voltage is applied by the voltage application means for the charging member.

23. An apparatus according to claim 22, wherein actuation and deactuation of the voltage application means for applying an AC voltage component between the charging member and the image bearing member and the voltage application means for applying the voltage to the transfer member are synchronized, and wherein the voltage applied between the transfer member and the image bearing member is a rectified voltage from an AC voltage.

24. An apparatus according to claim 23, wherein actuation and deactuation of said transfer member are effected when the image receiving member is absent between said transfer member and the image bearing member.

25. An apparatus according to claim 18, 19 or 20, wherein the voltage application means for the charging member and the voltage application means for the transfer member are common.

26. An apparatus according to claim 15, wherein said image bearing member has a photosensitive layer, and said latent image forming means includes exposure means for imagewisely exposing the photosensitive layer charged by said charging means.

27. An apparatus according to claim 26, wherein said photosensitive layer is of organic photosensitive material.

28. An apparatus according to claims 26 or 27, wherein said exposure means includes a laser scanner for exposing said photosensitive member in accordance with image information.

* * * * *

UNITED STATES PATENT AND TRADEMARK OFFICE

CERTIFICATE OF CORRECTION

PATENT NO. : 5,006,902

DATED : April 9, 1991

INVENTOR(S) : JUNJI ARAYA

It is certified that error appears in the above-identified patent and that said Letters Patent is hereby corrected as shown below:

COLUMN 12,

Line 55, "claim 10" should read --claim 9--.

COLUMN 8,

Line 45, "wa" should read --was--.

Signed and Sealed this

Fifteenth Day of June, 1993

*Attest:*

Michael K. Kirk

MICHAEL K. KIRK

*Attesting Officer*

*Acting Commissioner of Patents and Trademarks*